United States Patent [19]

Felder

[11] 4,128,746

[45] Dec. 5, 1978

[54] BRUSH AND RING DISTRIBUTOR

[76] Inventor: Donald W. Felder, 837 Hillside Dr., Sherman, Tex. 75090

[21] Appl. No.: 783,694

[22] Filed: Apr. 1, 1977

[51] Int. Cl.[2] ..... H01H 19/00; F02P 1/00

[52] U.S. Cl. ..... 200/24; 123/146.5 A; 200/25

[58] Field of Search ..... 200/DIG. 7, 8 R, 19 R, 200/24, 25, 26, 28; 123/146.5 A

[56] References Cited

U.S. PATENT DOCUMENTS

| | | | |
|---|---|---|---|
| 2,510,067 | 6/1950 | Callander | 200/28 X |
| 2,723,319 | 11/1955 | Sebring et al. | 200/25 |
| 2,756,293 | 7/1956 | Bitter | 200/25 |
| 2,834,095 | 5/1958 | Lazzopina et al. | 200/DIG. 7 |
| 3,022,389 | 2/1962 | Wolrab | 200/24 |
| 3,411,201 | 11/1968 | Krone | 200/24 X |

*Primary Examiner*—James R. Scott
*Attorney, Agent, or Firm*—Harrington A. Lackey

[57] ABSTRACT

A brush and ring distributor for controlling the primary circuit for distributor ignition systems of internal combustion engines, comprising a rotating segmented slip ring having one contact segment and two breaker segments per engine cylinder, used in conjunction with two carbon graphite type brushes mounted in a brush holder mounted to a conventional type point plate with electrical connections between the bottom brush and the point plate and electrical connections between the top brush and a coil and condenser. The two brushes running on the segmented slip ring contact a common segment and close the primary circuit. As the slip ring rotates the brushes contact separate breaker segments and lose contact with the common segment, opening the primary circuit.

3 Claims, 6 Drawing Figures

BRUSH AND RING DISTRIBUTOR

BACKGROUND OF THE INVENTION

1. Field of Invention

The present invention pertains generally to distributors for internal combustion engines and more particularly to distributors for high speed internal combustion engines.

It has long been the object of the automotive industry to develop low cost distributor systems that will remain in time during normal wear and will operate efficiently at higher RPM.

2. Summary of Invention

It is therefore a primary object of the present invention to provide a low cost distributor system that will remain in time during normal wear and maintain its efficiency at relative high RPM.

It is a further objective of the present invention to provide a trouble free distributor system that is simple in construction, has a long service life and is easy to maintain.

It is yet another object of the present invention to provide a distributor system that increases the dwell time, during which the primary circuit is energised and decrease the time the circuit is open to allow a higher voltage to be discharged by the secondary circuit for a shorter period of time to allow an increase in spark plug life.

It is yet another object of the present invention to provide a distributor system that can easily be used as an aftermarket modification as well as in production line fabrication.

Having in mind the above and other objects that will be evident from an understanding of this disclosure, the present invention comprises the combinations and arrangements of parts illustrated in the presently preferred embodiments of the invention which are hereinafter set forth in sufficient detail to enable those persons skilled in the art to clearly understand the functions, operation, construction and advantages of it when read in conjunction with the accompanying drawings.

DETAILED DESCRIPTION

Figure 1:
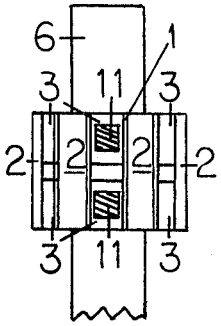
FIG. 1 is an explanatory view depicting the position of the brushes on the segmented slip ring when the primary circuit is open.

As seen in FIGS. 1 through 6, the brush and ring distributor system comprises a segmented slip ring 1 incorporating a contact segment 2 and two breaker segments 3 per cylinder used in conjunction with two carbon graphite type brushes 11 in a brush holder 8, mounted to a conventional type breaker plate 12 as would be used for a six cylinder engine to control the primary circuit of the ignition system.

FIG. 1 indicates the position of the brushes 11 in relation to the slip ring 1 when the slip ring 1 has rotated to breaker segments 3, the open position. Breaker segments 3 and contact segments 2 are separated and electrically insulated from each other and the distributor shaft. The slip ring core 1 is moulded of a nonconducting material with electrical conducting segments 2 and 3 so that when the brushes 11 are in contact with contact segments 2 the primary circuit is closed causing the primary windings in the coil to be energised, and when the brushes 11 are in contact with the breaker segments 3 only, electrical contact is broken, allowing the primary field to collapse, causing mutual induction in the coil and firing the spark plug with the secondary circuit.

Figure 3:
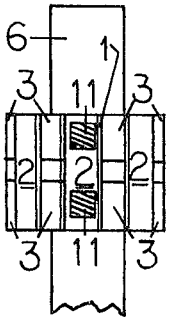
FIG. 3 is an explanatory view depicting the position of the brushes on the segmented slip ring when the primary circuit is closed.

FIG. 3 indicates the position of the brushes 11 when the slip ring 1 has rotated to the position where both brushes 11 are in contact with a contact segment 2 and the primary circuit is closed. When the brushes 11 are in contact in any amount with a contact segment 2 the primary circuit is energized and the circuit will be broken only during the short duration that brushes 11 are in contact only with breaker segments 3. When the segmented slip ring 1 has rotated to where the leading edges of brushes 11 are again contacting a contact segment 2, the circuit is again closed. Thus, with the brushes 11 one above the other and radially disposed except for a slight back tilt to prevent chatter in relation to the slip ring 1, dwell time is increased to cause a higher voltage to be discharged from the secondary circuit. Due to the lessened time the primary circuit is open, a spark will be discharged for a shorter period of time and result in increased spark plug life.

Figure 2:
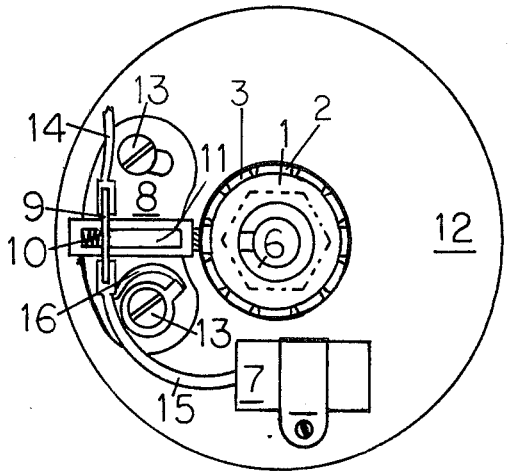
FIG. 2 is a top view of the distributor with cap and rotor removed.
Figure 4:
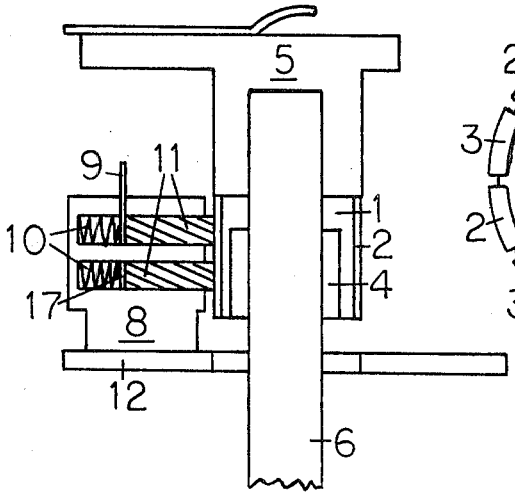
FIG. 4 is a cross sectional side view of the distributor.
Figure 5:
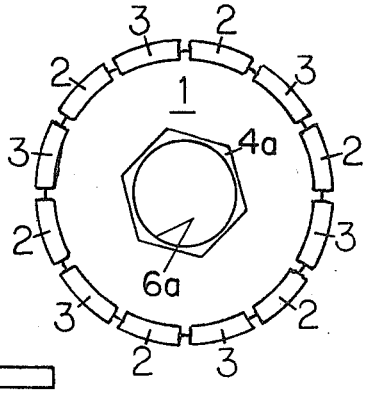
FIG. 5 is an enlarged bottom view of the segmented slip ring.
Figure 6:
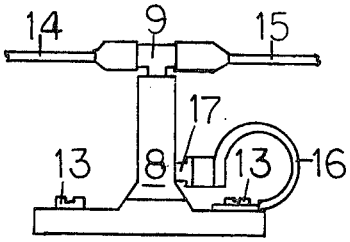
FIG. 6 is a rear view of the brush holder showing the electrical connections.

FIG. 2 is a top view of the brush and ring system installed in a conventional distributor as an aftermarket modification. The brush holder 8 is of a size and shape to mount to a conventional breaker plate 12 as a replacement for conventional breaker points. Terminal plate 9 located between spring 10 and brush 11 as seen in FIGS. 2, 4 and 6 provides a connection point for coil wire 14 and condenser wire 15. Terminal plate 17 also located between a spring 10 and a brush 11, as can be seen in FIGS. 4 and 6, provides a connection point for ground wire 16 which is attached to a mounting screw 13 to provide a positive ground as brush holder 8 is moulded of a non conductive material. FIG. 2 shows the slip ring 1 in position around the distributor shaft 6 and cam 4 in relation to brushes 11 and brush holder 8 as also seen in FIG. 4. The slip ring 1 is moulded to fit over the cam 4 as shown in FIGS. 4 and 5 and by the broken line in FIG. 2 when used as an aftermarket modification but would be moulded to fit directly to the distributor shaft 6 when initial construction and would eliminate the expense of grinding the cam. FIG. 5 discloses the molded hexagonal recess for receiving the cam 4, and also the molded circular aperture for receiving the distributor shaft 6.

In FIGS. 2 and 4 springs 10 can be seen as they exert pressure on terminal plates 9 and 17 which in turn holds brushes 11 against the slip ring 1. Terminal plate 9 extends through an elongated slot in the top of brush holder 8 as can be seen in FIGS. 2, 4 and 6. The slot is of sufficient length to allow the terminal plate 9 to move toward the slip ring 1 to compensate for normal wear of brushes 11 during operation. As brushes 11 wear they will still be in the same alignment with slip ring 1 and timing will remain approximately the same. Brush holder 8 also has an elongated slot in its side to accommodate terminal plate 17 connection point as seen in FIG. 6. The segmented slip ring 1 when slipped down over cam 4 is held in place during rotation by rotor 5 as seen in FIG. 4. FIG. 5 is a bottom view of the slip ring 1 indicating the contact segments 2 and the breaker segments 3 being alternated and with sufficient separation to provide positive breaking of the circuit during operation. The breaker segments 3 are radially disposed directly from the lobes of the cam for timing purposes. The tips of brushes 11 are contoured to the contour of the slip ring 1 during fabrication to provide a continous contact across the tip at initial installation to prevent any timing change as the brushes 11 wear in. The brushes 11 contact the slip ring 1 at a slight back tilt to prevent chatter as the slip ring 1 rotates.

In operation the brushes 11 have a smooth constant contact with the segmented slip ring 1 as it rotates, closing the primary circuit each time the brushes 11 contact a contact segment 2 and breaking the primary circuit each time the brushes 11 are in contact with only breaker segments 3, allowing more efficient utilization of a conventional coil and condenser 7 and also can be utilized with transistorized ignition systems. The brushes 11 and slip ring 1 have a long service life due to the known self-lubricating characteristics of carbon graphite type brushes 11.

The presently preferred embodiment of this invention is intended to cover both new fabrication and aftermarket modification.

Various modifications of the brush and ring distributor assembly will become apparent to those persons ordinarily skilled in the art and the present invention is intended to cover all such obvious modifications falling within the spirit and scope of the invention as defined in the appended claims.

I claim:

1. A brush and ring distributor assembly for an ignition circuit for an internal combustion engine including a primary coil, a secondary coil, a condenser, a rotary distributor shaft and a breaker plate, comprising:

(a) a generally cylindrical-shaped slip ring of insulative material fixedly mounted coaxially on said distributor shaft for rotary movement therewith, and having a peripheral surface, (b) a brush holder fixed to said breaker plate adjacent said distributor shaft, (c) first and second brushes mounted in said brush holder and continuously engaging said peripheral surface at axially spaced positions during rotary movement of said slip ring, (d) an electrically conductive contact segment for each engine cylinder, uniformly circumferentially spaced on said peripheral surface, each contact segment having an axial dimension great enough for periodical simultaneous electrical engagement by both said brushes as said slip ring rotates, to complete an electrical circuit through said first and second brushes, (e) a set of axially spaced, electrically conductive, breaker segments for each engine cylinder, uniformly circumferentially spaced on said peripheral surface, each set being located between adjacent pairs of contact segments, and each breaker segment being electrically insulated from every contact segment and every other breaker segment, (f) the spacing between each pair of breaker segments in each set being such that when said first brush contacts only one of said pair, said second brush contacts only the other of said pair, to open the electrical circuit between said first and second brushes, (g) said contact segments and said breaker segments being electrically insulated from said distributor shaft, (h) means in said brush holder electrically connecting said first brush to the primary coil in said ignition circuit, (i) means in said brush holder electrically grounding said second brush.

2. The invention according to claim 1 further comprising means in said brush holder biasing each of said first and second brushes into continuous engagement with said peripheral surface.

3. The invention according to claim 2 in which said means electrically connecting said first brush to the primary coil comprises a first terminal plate means between said biasing means and said first brush and in electrical contact with said first brush, and a first electrical conductor connecting said first terminal plate means to the primary coil, and second terminal plate means between said biasing means and said second brush and in electrical contact with said second brush, a second conductor being connected to said second terminal plate means and electrically grounded.

* * * * *